US005090179A

United States Patent [19]

Bickle

[11] Patent Number: 5,090,179

[45] Date of Patent: Feb. 25, 1992

[54] REUSABLE COIN COUNTER AND HOLDING DEVICE

[76] Inventor: William W. Bickle, P.O. Box 1318, The Pas, Manitoba, Canada, R9A 1L2

[21] Appl. No.: 711,036

[22] Filed: Jun. 6, 1991

[51] Int. Cl.[5] ..... B65B 11/56; B65B 67/08

[52] U.S. Cl. ..... 53/461; 53/213; 53/592; 206/0.8

[58] Field of Search ..... 53/213, 212, 254, 592, 53/461; 206/0.8

[56] References Cited

U.S. PATENT DOCUMENTS

| | | | |
|---|---|---|---|
| 201,264 | 3/1878 | Meaker . | |
| 1,095,256 | 5/1914 | Willis | 206/0.8 X |
| 1,130,978 | 3/1915 | Jackson | 206/0.8 X |
| 2,302,861 | 11/1942 | Hinkel | 206/0.8 X |
| 2,515,312 | 7/1950 | Newby, Sr. | 53/213 X |
| 3,085,378 | 4/1963 | Howard | 53/254 |
| 3,783,586 | 1/1974 | Dorman | 53/213 |

FOREIGN PATENT DOCUMENTS

| | | | |
|---|---|---|---|
| 1168543 | 9/1958 | France | 206/0.8 |
| 1208062 | 9/1959 | France | 206/0.8 |
| 1521201 | 4/1968 | France | 206/0.8 |

*Primary Examiner*—James F. Coan

*Attorney, Agent, or Firm*—Stanley G. Ade; Adrian Battison; Murray Thrift

[57] ABSTRACT

While measuring racks and the like are known to count or measure the number of coins required to wrap same into rolls, the actual wrapping requires considerable experience and dexterity and can be time consuming. The present device consists of a relatively thin plastic or card semi-circular trough having closed ends and a length equal to the required number of coins in a roil of that particular denomination with the curvature of the trough and length thereof varying with each denomination of coin. The entire trough and measured contents may then be wrapped in a conventional coin wrapper readily and easily as the closed ends of the trough retain the coins during the rollng process.

5 Claims, 1 Drawing Sheet

REUSABLE COIN COUNTER AND HOLDING DEVICE

BACKGROUND OF THE INVENTION

This invention relates to new and useful improvements in methods and apparatus for rolling coins into cylinders containing a predetermined number of coins depending upon the denomination thereof.

For example, it is conventional in Canada to roll coins of a one cent denomination in rolls of fifty, five cent denomination in rolls of forty, ten cent denomination in rolls of fifty, and twenty-five cent denomination in rolls of forty all of which can be fitted to a conventional substantially rectangular coin wrapper made of paper or plastic.

While counting devices exist to count off the various denominations in the desired numbers mentioned above, it is then necessary to grasp the roll of coins and remove it from the measuring device, place it upon the coin wrapper and then manipulate the wrapper around the roll and roll up the predetermined number of coins into a relatively tight roll.

While it is not so difficult to manipulate a roll of forty quarters, it can be extremely difficult to manipulate a roll of fifty pennies or fifty dimes due to the relative long length of such a roll of loose coins compared to the diameter thereof.

It requires considerable dexterity in order to roll coins with any speed and in any event it is a time consuming and boring experience for the operators.

The present device overcomes disadvantages inherent with conventional measuring and rolling of coins by firstly providing a semi-circular trough having closed ends and having a diameter or arc or curvature similar to that of the coins being stacked therein with the closed ends of the trough limiting the number of coins to a predetermined amount depending upon the denomination thereof.

This makes it relatively easy to stack the coins in the trough and when the trough is full, the required number of coins is present.

Rather than removing the coins from the trough, it is desirable that the entire combination of trough and coins is then rolled in a conventional coin wrapper readily and easily with the closed ends of the trough holding the coins in place rather than the fingers of the operator during the rolling operation. However the coins may be removed from the trough and easily placed in position on a coin wrapper.

One aspect of the invention is to provide a reusable coin holder and automatic quantity selection device comprising an arcuately curved cross section trough and a vertical wall at each end of the said trough.

Another aspect of the invention is to provide a method of counting and rolling coins comprising the steps of filling a substantially semi-circular cross-sectional closed ended trough with coins of the same denomination, from one end to the other, thereby measuring a predetermined number of said coins, placing said trough transversely on a coin wrapper and spaced inwardly from one end thereof, folding said one end partially around said trough, and rolling the trough of coins within said wrapper until fully enclosed therein and then tucking the side ends of said wrapper inwardly against the closed ends of said trough.

A still further advantage of the invention is to provide a relatively simple counting and stacking trough which is reusable and which can be made either of stiff card or relatively thin plastic.

A still further advantage of the invention is to provide a device of a character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
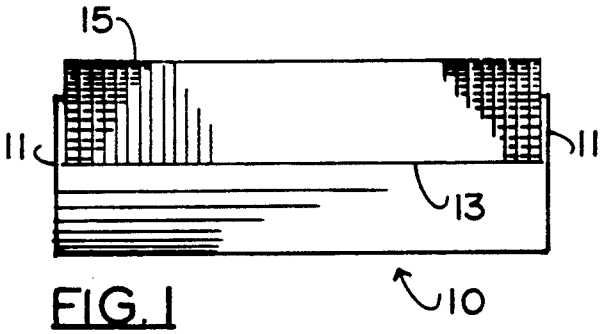
FIG. 1 is a side elevation of a trough showing coins therein.
Figure 2:
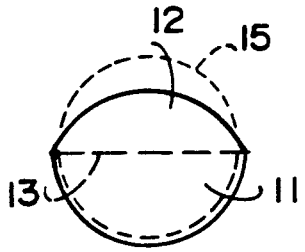
FIG. 2 is an end view of FIG. 1.

Proceeding to describe the invention in detail, reference should first be made to FIGS. 1 and 2 which show a substantially semi-circular trough collectively designated 10 and manufactured from relatively thin plastic or stiff card.

Figure 3:
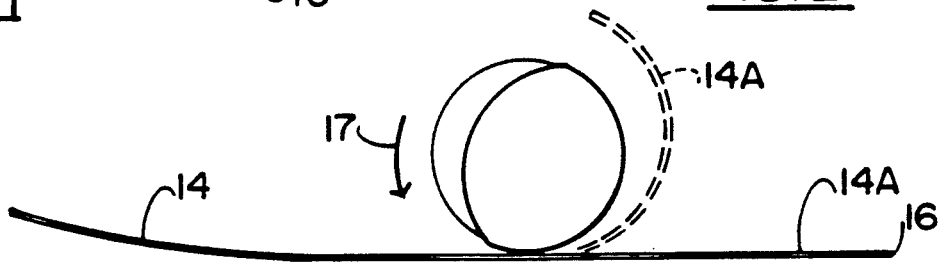
FIG. 3 is a partially schematic end elevation of the trough of FIG. 1, filled with coins, and placed on a wrapping paper ready for rolling.
Figure 4:
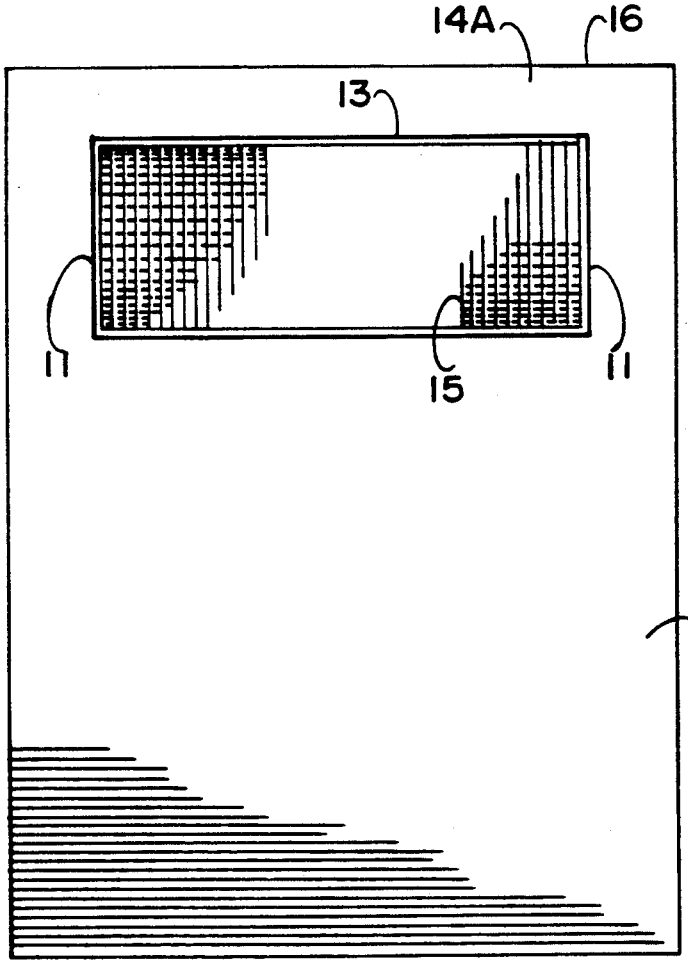
FIG. 4 is a top plan view of FIG. 3.

It is provided with vertically situated end closing panels 11 and the upper sides or edges 12 of these end panels preferably extends above the upper edges 13 of the semicircular trough 10 thus giving plenty of room for the fingers of the operator to manipulate the device when rolling same in a conventional wrapper illustrated in FIGS. 3 and 4 by reference character 14.

It will of course be appreciated that these ends can be the same height as the edges 13 of the trough but under those circumstances, the fingers tend to engage the end coins 15 rather than the end panels 11.

The curvature of the trough 13 is preferably just slightly greater than the curvature of the denomination of coins for which it is designed so that the requisite number of coins fits snugly into the trough when full and are frictionally held in position until inverted at which time of course they are easily displaced into a till or the like.

Once the requisite number of coins has been placed within the trough, it is situated transversely of one end 16 of the wrapper and centered as shown in FIG. 4 whereupon the rear end portion 14A of the wrapper is lifted up and over both the trough and the coins as shown in phantom in FIG. 3. This action may be facilitated by rolling the trough slightly rearwardly as the end 14A is brought over the trough whereupon both the trough and wrapper are rolled in the direction of arrow 17 until the entire wrapper has been rolled around both the trough and the coins contained therein at which point the ends of the wrapper are folded inwardly in the usual manner and pressed into position thus detachably sealing the package as is conventional.

If the troughs are made of plastic, they are of course reusable but if formed from relatively thin stiff card, they may be disposable or under certain circumstances reusable depending upon the choice of the users.

Another advantage of the device is that, when rolled in a coin wrapper it is much more difficult to pilfer one or more coins from the end and then re-position the end of the wrapper to conceal pilferage unless the remaining coins are actually counted. With this device, a shake will cause the remaining coins to rattle even if only one coin has been extracted.

While such pilferage is not particularly frequent with small denomination coins, it can be with twenty-five cents, fifty cents and one-dollar coins.

Since various modifications can be made in my invention as hereinabove described, and many apparently widely different embodiments of same made within the spirit and scope, it is intended that all matter contained in the accompanying specification shall be interpreted as illustrative only and not in a limiting sense.

I claim:

1. A method of counting and rolling coins comprising the steps of:

(a) filling a substantially semi-circular cross-sectional close ended trough with coins of the same denomination, from one end to the other, thereby measuring a predetermined number of said coins;

(b) placing said trough transversely on a coin wrapper and spaced inwardly from one end thereof;

(c) folding said one end partially around said trough; and (d) rolling the trough of coins within said wrapper until fully enclosed therein and then tucking the side ends of said wrapper inwardly against the closed ends of said trough.

2. A reusable coin holder and automatic quantity selection device comprising an arcuately curved cross section trough and a vertical wall at each end of said trough, and a flexible coin wrapping sheet, said sheet enclosing said holder with the predetermined number of coins therein, into a coin roll.

3. The device according to claim 2 in which the vertical walls extend upwardly beyond the upper edges of the trough with the upper edges of said vertical walls being arcuately curved.

4. The device according to claim 2 in which the length of said trough is modular to receive only a predetermined number of coins thereby automatically ensuring the correct predetermined number of coins of the denomination fitting the trough radially and longitudinally.

5. The device according to claim 3 in which the length of said trough is modular to receive only a predetermined number of coins thereby automatically ensuring the correct predetermined number of coins of the denomination fitting the trough radially and longitudinally.

* * * * *